US009873439B2

(12) United States Patent
Moritzhuber et al.

(10) Patent No.: US 9,873,439 B2
(45) Date of Patent: Jan. 23, 2018

(54) CABLE CAR SYSTEM FOR TRANSPORTING PEOPLE

(71) Applicant: INNOVA PATENT GMBH, Wolfurt (AT)

(72) Inventors: Johannes Moritzhuber, Hard (AT); Markus Beck, Fussach (AT); Peter Luger, Dornbirn (AT)

(73) Assignee: Innova Patent GmbH, Wolfurt (AT)

( * ) Notice: Subject to any disclaimer, the term of this patent is extended or adjusted under 35 U.S.C. 154(b) by 0 days.

(21) Appl. No.: 15/311,956

(22) PCT Filed: May 18, 2015

(86) PCT No.: PCT/AT2015/000074
§ 371 (c)(1),
(2) Date: Nov. 17, 2016

(87) PCT Pub. No.: WO2015/184478
PCT Pub. Date: Dec. 10, 2015

(65) Prior Publication Data

US 2017/0120933 A1 May 4, 2017

(30) Foreign Application Priority Data

Jun. 2, 2014 (AT) ..... A 433/2014

(51) Int. Cl.
*B61B 1/00* (2006.01)
*B61B 1/02* (2006.01)
(Continued)

(52) U.S. Cl.
CPC ..... *B61B 1/02* (2013.01); *B61B 7/00* (2013.01); *B61B 12/00* (2013.01)

(58) Field of Classification Search
CPC .. B61B 1/00; B61B 1/02; B61B 1/005; B61B 7/00; B61B 7/02; B61B 7/04; B61B 12/00
See application file for complete search history.

(56) References Cited

U.S. PATENT DOCUMENTS 217,925 A * 7/1879 Burton ..... E01B 25/305 104/124
7,246,559 B2 * 7/2007 Stromberg ..... B61B 3/02 104/124
(Continued)

FOREIGN PATENT DOCUMENTS

CA 2325044 A1 5/2002
DE 202008002698 U1 8/2009
(Continued)

*Primary Examiner* — Jason C Smith
(74) *Attorney, Agent, or Firm* — Laurence A. Greenberg; Werner H. Stemer; Ralph E. Locher

(57) ABSTRACT

A cable car system for transporting people includes at least one vehicle to be coupled along a line to a transport cable, to be moved by the cable in stations and to be moved past at least one embarkation or disembarkation area in which passengers board or leave the vehicle. A conveyor is provided in the embarkation or disembarkation area. A screen is provided for the passengers between the motion path of the vehicle and the embarkation and disembarkation area, to protect the passengers against climatic and acoustic conditions prevailing outside the station building. The screen has at least one opening through which the passengers move to the at least one vehicle or to the disembarkation area. The conveyor is located within the opening and extends only over a part of the length of the opening in the motion direction of the vehicle.

7 Claims, 1 Drawing Sheet

(51) Int. Cl.
*B61B 12/00* (2006.01)
*B61B 7/00* (2006.01)

(56) References Cited

U.S. PATENT DOCUMENTS

| | | | | |
|---|---|---|---|---|
| 7,559,281 | B2 * | 7/2009 | Huard | B61B 12/105 104/173.1 |
| 7,802,523 | B2 | 9/2010 | Moritzhuber et al. | |
| 7,832,339 | B2 * | 11/2010 | Richard | B61B 10/02 104/173.1 |
| 8,479,657 | B2 | 7/2013 | Switzeny | |
| 8,960,096 | B2 * | 2/2015 | Veyrat | B61B 1/00 104/173.1 |
| 2004/0011240 | A1 * | 1/2004 | Gabriel | B61B 12/022 104/173.1 |
| 2006/0252562 | A1 * | 11/2006 | Anderson | A63G 21/20 472/32 |
| 2007/0251407 | A1 * | 11/2007 | Gabriel | B61B 12/022 104/180 |
| 2009/0260949 | A1 * | 10/2009 | Huber | B61B 12/022 198/324 |
| 2010/0018434 | A1 * | 1/2010 | Moritzhuber | B61B 7/00 104/178 |
| 2010/0043666 | A1 * | 2/2010 | Moritzhuber | B61B 12/022 104/180 |
| 2011/0022252 | A1 * | 1/2011 | Dueck | B61B 1/00 701/19 |
| 2011/0126731 | A1 * | 6/2011 | Vacher | B61B 1/02 104/31 |
| 2012/0103226 | A1 * | 5/2012 | Moritzhuber | B61B 12/022 104/173.2 |
| 2015/0075403 | A1 * | 3/2015 | Moritzhuber | B61B 1/02 104/28 |
| 2016/0016593 | A1 * | 1/2016 | Luger | B61B 3/02 104/87 |
| 2016/0207542 | A1 * | 7/2016 | Lieber | E06B 11/022 |
| 2017/0120933 | A1 * | 5/2017 | Moritzhuber | B61B 1/02 |

FOREIGN PATENT DOCUMENTS

| | | | | |
|---|---|---|---|---|
| EP | 2147843 | A1 | 1/2010 | |
| EP | 2199172 | A2 | 6/2010 | |
| FR | 2693696 | A1 | 1/1994 | |
| WO | 2009082827 | A1 | 7/2009 | |
| WO | WO 2009082827 | A1 * | 7/2009 | B61B 12/022 |

* cited by examiner

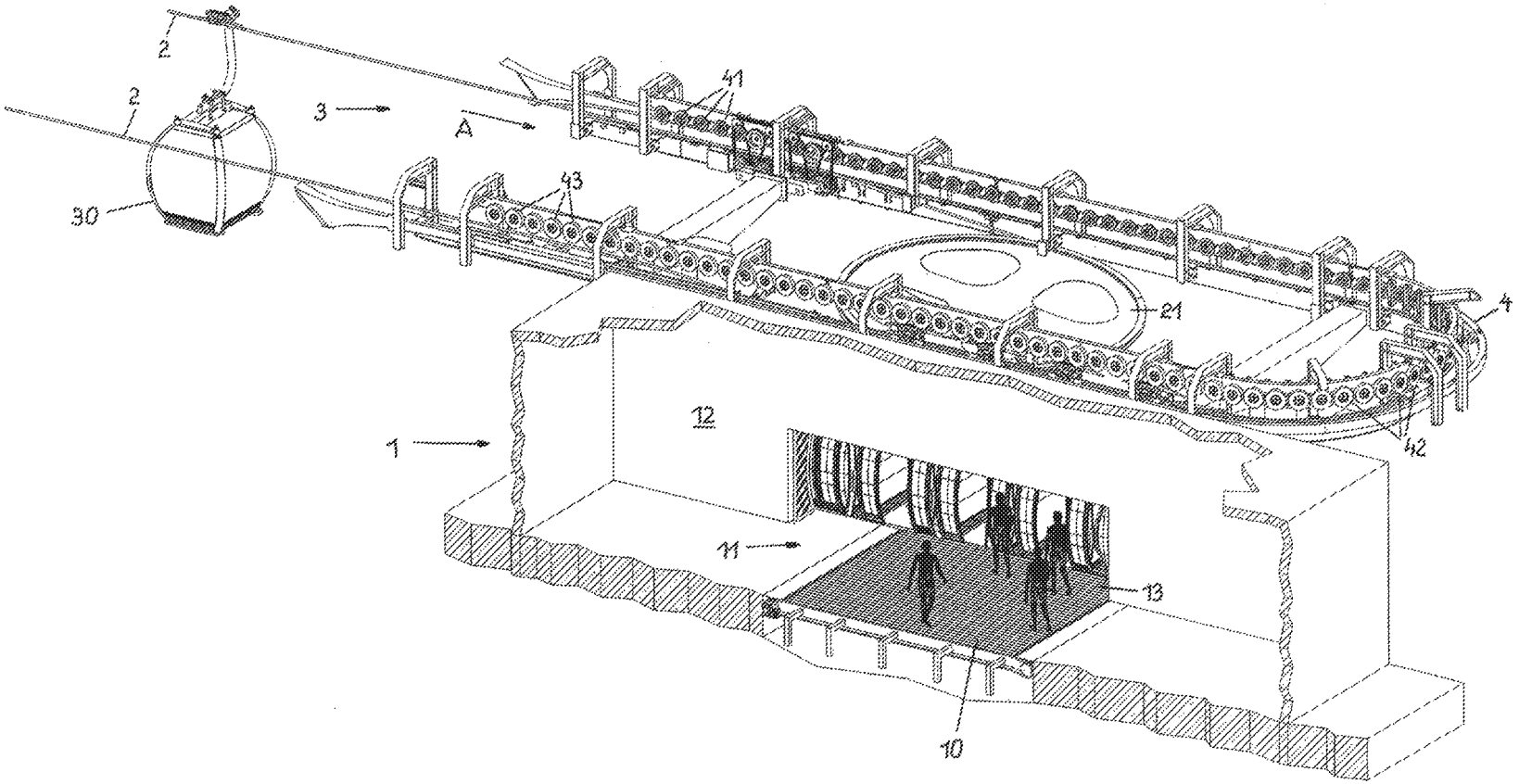
4
42
21
13
10
41
12
11
43
A
1
3
2
2
30

CABLE CAR SYSTEM FOR TRANSPORTING PEOPLE

BACKGROUND OF THE INVENTION

Field of the Invention

The present invention relates to a cable car system for transporting people, comprising at least one vehicle configured with a vehicle cabin, which vehicle can along the line be coupled to a transport cable or, by means of a hauling cable coupled to the latter, is transported along at least one carrying cable or along a track, wherein along the line it is coupled to the transport cable or to the hauling cable and in the stations it is uncoupled from the transport cable or from the hauling cable, is moved through the station and is moved past at least one embarkation or disembarkation area in which the passengers board or leave the vehicle, whereupon it is recoupled to the transport cable or to the hauling cable and is moved out of the station, wherein in the embarkation or disembarkation area is provided a conveyor, which is moved in the direction of the at least one vehicle and is moved at least approximately at the speed of the vehicle and by which those passengers who enter or leave the at least one vehicle cabin moving past the embarkation or disembarkation area, respectively, are moved along in the motional direction of the vehicle.

A cable car system of this type is known, for example, from WO 2009/082827 A1.

In known cable car systems of this type, the passengers boarding the vehicles are located on a platform from which they enter into vehicle cabins moving past said platform or onto which the passengers exiting the moving vehicle cabins arrive. In order to enable the embarkation or disembarkation of the passengers, the vehicles are moved past the platform at a relatively low speed of, for example, 0.3 m/sec. As a result of this low speed which is necessary for the operation, the transport capacity of the cable car system is limited. Regardless of this low speed, the embarkation and disembarkation poses a difficulty for passengers with handicaps, in particular for passengers in wheelchairs. Even for non-handicapped people, the movement of the vehicles induces stress for the embarking or disembarking passengers.

As far as the transport capacity is concerned, this can be boosted by increasing the length of the embarkation and disembarkation area and the number of vehicles which are assigned thereto and move past the platforms. As far as the stress induced in the passengers, in particular when entering the vehicles, is concerned, this can only be reduced by still further lowering the speed of the vehicles moving past the platforms.

As a result of the conveyor, the entering and exiting of the vehicle cabins is made significantly easier for the passengers.

BRIEF SUMMARY OF THE INVENTION

Known cable car systems do not however meet the requirements of enhanced comfort, since the embarkation and disembarkation areas are located outside the station building, so that the passengers are exposed to the climatic and acoustic conditions prevailing outside the station building. The object of the present invention is to bring about, in this respect, a significant increase in comfort. This is achieved according to the invention by virtue of the fact that between the motional path of the at least one vehicle and the embarkation and disembarkation area there is provided for the passengers a screen, in particular a wall, by which the passengers present in the embarkation or disembarkation area are very largely protected, on the one hand, against the climatic conditions prevailing outside the station building and, on the other hand, against the acoustic emissions caused by the operation of the cable car system and which is configured with at least one opening through which the passengers move from the embarkation area to the at least one vehicle cabin or from this to the disembarkation area, wherein the conveyor is located within this at least one opening and wherein it extends in the motional direction of the vehicle only over a part of the length of this at least one opening.

It is hereby ensured that the passengers are not exposed to the climatic and acoustic conditions prevailing outside the station building.

Preferably, the conveyor extends in the motional direction of the vehicle only over approximately two-thirds of the length of the at least one opening.

According to further preferred features, the conveyor is moved at the same speed as the at least one vehicle moving past the embarkation or disembarkation area. In particular, the conveyor has a width which lies between half the length and the total length of the conveyor.

BRIEF DESCRIPTION OF THE SEVERAL VIEWS OF THE DRAWING

A cable car system according to the invention is explained in greater detail below with reference to an illustrative embodiment represented in the drawing, wherein:

FIG. 1 shows a station of a cable car system according to the invention, in axonometric representation.

DESCRIPTION OF THE INVENTION

In FIG. 1 is represented a station of a cable car system, which has a station building 1. The cable car system is configured with a transport cable 2, to which, along the line, vehicles 3 having vehicle cabins 30 are coupled. In the stations, the transport cable 2 is guided over deflection pulleys 21. At least one of the deflection pulleys 21 is driven. The transport cable 2 is moved at a constant speed of, for example, 7 m/sec to 10 m/sec. The vehicles 3 are moved in the direction of the arrow A.

In the station, the vehicles 3, after having been uncoupled from the transport cable 2, are moved through the station along guide rails 4. Following the uncoupling of the vehicles 3 from the transport cable 2, the speed of the vehicles 3 is reduced to about 0.3 m/sec by means of deceleration tires 41. At this speed, the vehicles 3 are moved by means of transport tires 42 past the embarkation and disembarkation area for the passengers. Subsequently, the speed of the vehicles 3 is increased to the speed of the transport cable 2 by means of acceleration tires 43, whereupon the vehicles 3 are recoupled to the transport cable 2.

For the entering of the vehicle cabins 30 or following the exiting thereof, the passengers are found in the embarkation or disembarkation area 11, respectively, which is located within the station building 1.

The station building 1 is closed off from the motional path of the vehicles 3 by a wall 12, which is located directly beside the motional path of the vehicle cabins 30. In this wall 12 is provided an opening 13, through which the passengers make their way from the embarkation area 11 into the vehicle cabins 30 or make their way out of the vehicle cabins 30 into the disembarkation area 11.

As a result of the wall 12, the passengers present in the embarkation or disembarkation area 11 find themselves very largely protected, on the one hand, from the climatic conditions prevailing outside the station building 1 and, on the other hand, from the acoustic emissions caused by the operation of the cable car system.

Since the distance between the wall 12 and the vehicle cabins 30 can amount to just a few centimeters, the passengers, when boarding or when leaving the vehicle cabins 30, are protected from climatic and acoustic nuisances.

In the region of the opening 13 is found a conveyor 10, which is moved at an at least approximately same speed as the vehicles 3, thus, for example, at a speed of 0.3 m/sec, in the same direction as the vehicles 3. The passengers who want to access the vehicle cabins 30 thus step for the moment onto the conveyor 10. As soon as they are on the conveyor 10, they are moved at approximately the same speed as the vehicle cabins 30, so that they can step into the vehicle cabins 30 without any stress. This applies, in particular, to passengers of restricted mobility. The same also applies also to those passengers who leave the vehicle cabins 30. Since the stepping onto or leaving of the conveyor 10 is easier than the boarding of the vehicle cabins 30 through their door opening, the speeds of the vehicles 3 and of the conveyor 10 can hereby be increased, so that a boosting of the transport capacity of the cable car system is also achievable.

Preferably, the conveyor 30 extends within the opening 13 only over a part of the length of the opening 13, so that collisions of the passengers with that end wall of the opening 13 which is located in the direction of transport are avoided. Preferably, the length of the conveyor 10 here amounts to about 50% to 80%, in particular 70%, of the length of the opening 13.

The invention claimed is:

1. A cable car system for transporting people, the cable car system comprising:

a station including a station building having at least one embarkation or disembarkation area for passengers;

a transport cable or a hauling cable coupled to a transport cable;

at least one vehicle having a vehicle cabin, said at least one vehicle being coupled to said transport cable or hauling cable along a line and being transported along at least one carrying cable or a track in a movement direction along a motion path, said at least one vehicle being coupled to said transport cable or hauling cable along the line, being uncoupled from said transport cable or hauling cable in said station, being moved through said station, being moved past said at least one embarkation or disembarkation area permitting passengers to board or leave said at least one vehicle, and being recoupled to said transport cable or hauling cable and moved out of said station;

a wall disposed directly alongside said motion path of said at least one vehicle, said wall closing off said motion path of said at least one vehicle from said embarkation and disembarkation area for protecting the passengers present in said embarkation or disembarkation area against climatic conditions prevailing outside said station building and against acoustic emissions caused by operation of the cable car system, said wall having at least one opening through which the passengers move between said embarkation or disembarkation area and said vehicle cabin, said at least one opening having a length; and a conveyor being disposed in said embarkation or disembarkation area, being located within said at least one opening and extending in said motion direction of said at least one vehicle only over a part of said length of said at least one opening, said conveyor being moved in said movement direction of said at least one vehicle at least approximately at a speed of said at least one vehicle permitting passengers entering or leaving said vehicle cabin moving past said embarkation or disembarkation area to be moved along in said movement direction of said at least one vehicle.

2. The cable car system according to claim 1, wherein said conveyor extends in said motion direction of said at least one vehicle only over approximately two-thirds of said length of said at least one opening.

3. The cable car system according to claim 1, wherein said conveyor and said at least one vehicle moving past said embarkation or disembarkation area are moved at an identical speed.

4. The cable car system according to claim 1, wherein said conveyor has a length, and said conveyor has a width lying between one-half and all of said length of said conveyor.

5. The cable car system according to claim 1, wherein said at least one vehicle moves continuously while the passengers are entering or leaving said vehicle cabin moving past said embarkation or disembarkation area in said movement direction.

6. The cable car system according to claim 1, wherein said opening in said wall is permanently open.

7. The cable car system according to claim 6, wherein said wall extends entirely along said embarkation or disembarkation area.

* * * * *